US007334410B2

(12) United States Patent
Creighton et al.

(10) Patent No.: US 7,334,410 B2
(45) Date of Patent: Feb. 26, 2008

(54) SWIRLER

(75) Inventors: Sherman C. Creighton, Manchester, CT (US); Charles B. Graves, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 774 days.

(21) Appl. No.: 10/820,310

(22) Filed: Apr. 7, 2004

(65) Prior Publication Data

US 2005/0223710 A1 Oct. 13, 2005

(51) Int. Cl.
*F23R 3/14* (2006.01)

(52) U.S. Cl. ..... 60/772; 60/748

(58) Field of Classification Search ..... 60/722, 60/737, 738, 743, 748, 772, 776
See application file for complete search history.

(56) References Cited

U.S. PATENT DOCUMENTS

| | | | | |
|---|---|---|---|---|
| 3,682,390 | A * | 8/1972 | Cheshire et al. | 60/748 |
| 5,253,478 | A * | 10/1993 | Thibault et al. | 60/748 |
| 5,603,211 | A | 2/1997 | Graves | |
| 5,966,937 | A | 10/1999 | Graves | |
| 6,415,610 | B1 * | 7/2002 | Parker | 60/748 |
| 6,901,756 | B2 * | 6/2005 | Gerendas et al. | 60/748 |

* cited by examiner

*Primary Examiner*—L. J. Casaregola
(74) *Attorney, Agent, or Firm*—Bachman & LaPointe, P.C.

(57) ABSTRACT

A gas turbine engine combustor swirler has vanes with a spanwise chord length distribution providing a desired swirl distribution.

19 Claims, 3 Drawing Sheets

SWIRLER

BACKGROUND OF THE INVENTION (1) Field of the Invention

The invention relates to fuel nozzles for combustors for gas turbine engines. More particularly, the invention relates to the configuration of the vanes of a swirler.

(2) Description of the Related Art

As is well known in the gas turbine engine technology it is desirable to operate the combustor at a combination of high efficiency, good lean blowout characteristics, good altitude relight characteristics, low smoke and other pollutant output, long life, and low cost. Scientists and engineers have been experimenting with the designs of the fuel nozzles for many years in attempts to maximize the efficacy of the combustor.

U.S. Pat. No. 5,966,937 (hereinafter the '937 patent, the disclosure of which is incorporated by reference herein as if set forth at length) discloses a swirler wherein the vanes of the inner duct have a spanwise distributed twist producing a desired swirl angle distribution at the inner duct outlet. The exemplary distribution places the vane chord closer to radial near the outboard/aft wall of the duct than near the inboard/fore wall (in an exemplary implementation, a rearward/aft direction being the downstream flow direction, which may be a rearward direction of the engine).

Nevertheless, there remains room for improvements in swirler construction.

SUMMARY OF THE INVENTION

One aspect of the invention involves a swirler vane pack having an array of vanes and means holding the vanes. Each of the vanes may have first and second ends with a span therebetween and a spanwise changing section.

In various implementations, a spacing between adjacent ones of the vanes may be essentially spanwise constant. The spanwise changing section may comprise a spanwise changing chord. The second end may have a chord that is 25%-75% of a chord of the first end. The spanwise changing section may comprise a spanwise monotonically changing chord. The vanes may be unitarily formed with the means. The vane first ends may be proximal of the means and the vane second ends may be distal of the means. The spanwise changing section may comprise a spanwise monotonically distally decreasing chord. The spanwise changing section may be essentially symmetric across a chord (e.g., to not provide airfoil lift). The spanwise changing section may be characterized by first and second flat facets along a major portion of a chordwise length of the vanes. Each of the vanes may be untwisted.

Another aspect of the invention involves a method for engineering the vane pack. A target change in swirl angle across a passageway associated with the vane pack is determined. A distribution of the spanwise change in section effective to achieve the target change in swirl angle at a target operating condition is determined. Lean blow out characteristics of a swirler incorporating the vane pack may be measured.

Another aspect of the invention involves a swirler assembly including a fuel injector. A bearing is coaxial with the fuel injector and has an outer surface forming a first surface of a first passageway from an inlet to an axial outlet. A prefilmer is coaxial with the fuel injector and has an inner surface forming a second surface of the first passageway and an outer surface forming a first surface of a second passageway from an inlet to an axial outlet. A first array of vanes is in the first passageway, each vane extending from a first end proximate the first passageway first surface to a second end proximate the first passageway second surface and having a section characterized by a spanwise decrease in chord of at least 25% from said first end to said second end. A second array of vanes is in the second passageway.

In various implementations, the first and second passageway inlets may be circumferential inlets. The spanwise decrease in chord may be effective to provide, at a target operating condition, a discharge profile characterized by swirl angle of: a peak value located between 0% and 25% of an exit radius; and a swirl angle of between 15° and 25° at a location between 95% and 100% of the exit radius. The spanwise decrease in chord may be effective to provide, at a target operating condition, a discharge profile characterized by a swirl angle of: a peak value located between 15% and 25% of an exit radius; and a swirl angle of between 18° and 21° at a location between 95% and 100% of the exit radius. The peak value may be in excess of 85°.

Another aspect of the invention involves a high shear design fuel injector for a combustor of a gas turbine engine. A fuel nozzle is supported at an inlet of the combustor. A first radial inlet swirler is mounted on the fuel nozzle and includes a first passage for flowing air into the combustor and is coaxially disposed relative to the fuel nozzle. A second radial inlet swirler is mounted adjacent to the first radial swirler and includes a second passage for flowing additional air into the combustor and is concentrically disposed relative to the first passage. The first radial inlet swirler has circumferentially disposed vanes. Each of the vanes has a span between first and second ends and has a spanwise change in section effective to change the swirl angle from the first end to the second end to offset the swirl to a higher level than the swirl would be without the change in section so as to produce a Rankine vortex.

In various implementations, a majority of the air in the first passage and the second passage may be in the first passage. The amount of air in the first passage may be substantially equal to 50%-95% of the total air flow in the first passage and second passage. A bulk swirl angle of air at a discharge of the second passage may be substantially between 60° and 75°.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
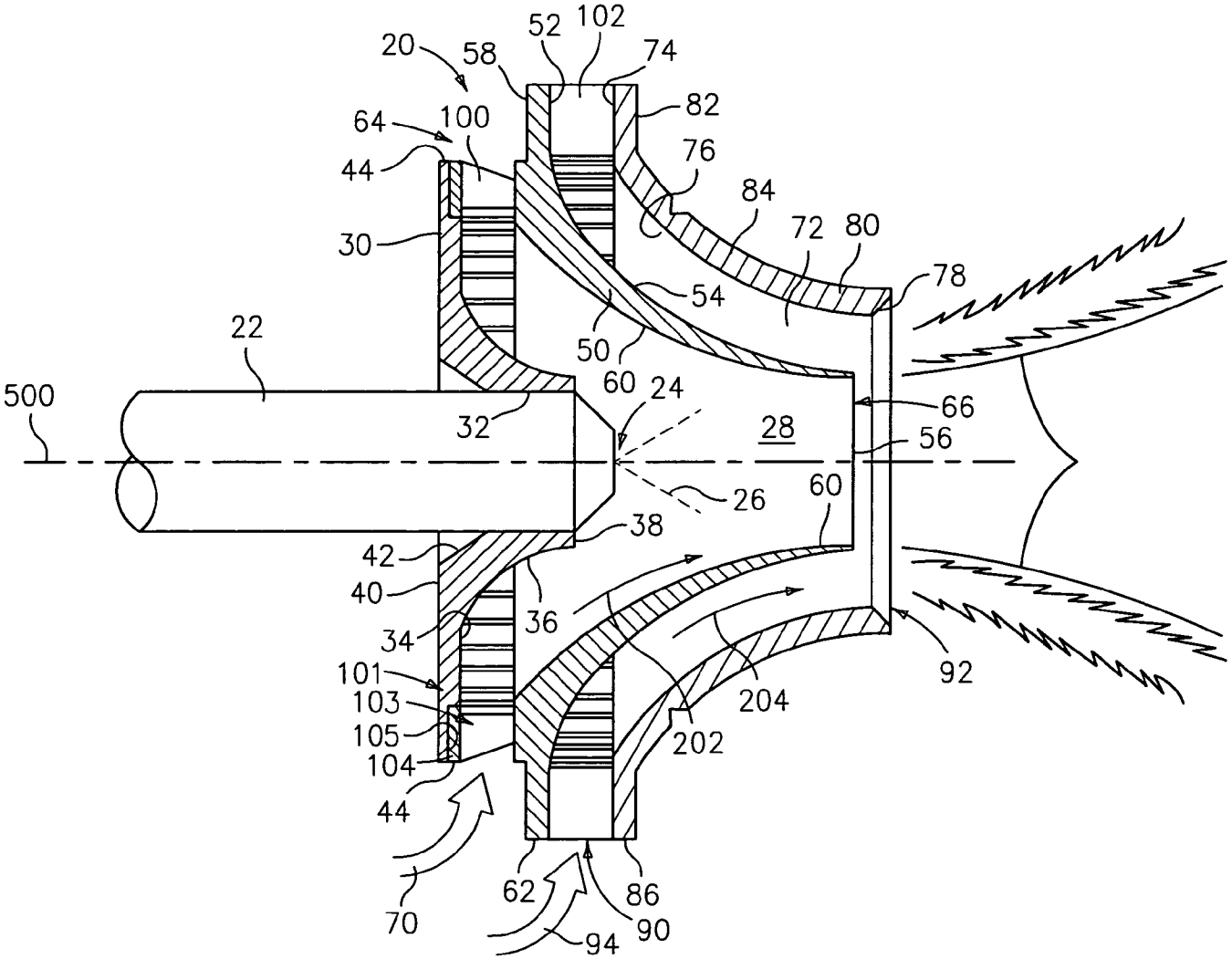
FIG. 1 is a longitudinal sectional view of a swirler.

FIG. 1 shows a combination of a swirler assembly 20 and a fuel injector nozzle 22. The nozzle has a distal end outlet 24 discharging a fuel spray 26 into an inner duct or passageway 28 of the swirler. The swirler and injector nozzle share a central longitudinal axis 500. The fore end of the swirler is formed by a bearing 30 having a cylindrical interior surface 32 that closely accommodates the injector nozzle allowing relative longitudinal movement of the nozzle and swirler. The exemplary bearing has generally aft and fore surfaces 34, 36, 38 and 40, 42. The aft and fore surfaces extend between a circumferential perimeter rim surface 44 and the cylindrical interior surface 32. In the exemplary embodiment, the aft surface has a radially-extending outboard portion 34 extending inward from the perimeter rim surface 44, a curved portion 36 transitioning therefrom to near longitudinal, and an inboard radial rim portion 38 extending to the cylindrical interior surface 32. The fore surface has a radially-extending outboard portion 40 and a rearwardly/inwardly tapering portion 42 extending to the cylindrical interior surface 32. Spaced rearwardly of the bearing is a prefilmer 50 having generally aft and fore surfaces 52, 54, 56 and 58, 60. The aft surface includes a radially-extending outboard portion 52 extending inward from a perimeter rim surface 62, a longitudinally concavely curved, rearwardly converging, transition portion 54, and an aft rim portion 56 extending radially inward at the end of the curved portion. The fore surface includes a stepped radially-extending outboard portion 52 extending inward from the rim 62 and a longitudinally convexly curved, rearwardly converging, transition portion 60 extending therefrom to the rim 56. The bearing aft surface and prefilmer fore surface generally cooperate to define the inner passageway 28 and an inner flowpath 202 extending radially inward from an inlet 64 and curving aft to an outlet 66 at the rim surface 56. Air 70 entering the inlet 64 mixes with the fuel 26 in a downstream central portion of the inner passageway 28 to be expelled as a mixture from the outlet 66.

An outer passageway 72 is formed between the prefilmer aft surface and the fore surface 74, 76 and divergent rim surface 78 of an outer wall 80. The outer wall 80 has an aft surface 82, 84. The outer wall aft and fore surfaces have radial portions 82 and 74 extending inward from a circumferential outer rim 86 and respectively transitioning to longitudinally concave and convex portions 84 and 76 meeting at the aft rim 78. The second passageway defines a flowpath 204 from an inlet 90 between the prefilmer and outer wall outer rims 62 and 86 to an outlet 92 at the junction of the outer wall aft surface 84 and rim surface 78. In the exemplary embodiment, the inner passageway outlet is recessed slightly behind the second passageway outlet so that the two passageways begin to merge at that point.

Inlet portions of the first and second passageways carry first and second circumferential arrays of vanes 100 and 102 so as to impart swirl to the air flowing therethrough. General operation may be as described in the '937 patent. Whereas the '937 patent discloses achieving a desired swirl profile by an appropriately distributed twist of vanes having otherwise constant section, the exemplary embodiment achieves this by varying blade section without such twist. In the exemplary embodiment, the bearing is formed with a main piece 101 and a vane pack 103 including the vanes 100. A base portion 104 of the vane pack rides in a rebate 105 in the main piece and has exposed perimeter and aft surfaces respectively forming portions of the perimeter 44 and surface 34.

Figure 2:
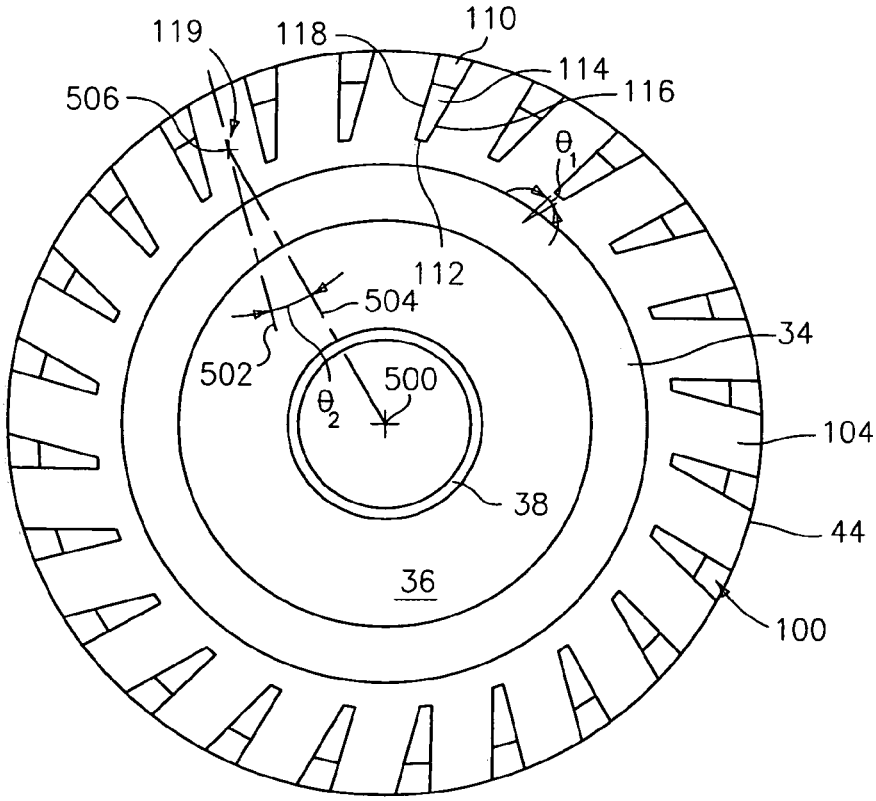
FIG. 2 is an end view of a swirler vane array of the swirler of FIG. 1.

FIG. 2 shows each vane 100 as extending between leading and trailing edges 110 and 112 from a proximal end at the platform 104 to a distal end 114. The exemplary vanes have first and second side surfaces 116 and 118 having major flat portions converging radially inward at an angle $\theta_1$. Exemplary $\theta_1$ may be between 0.5° and 5°, more narrowly, 0.5° and 2°. In the exemplary embodiment, the first surface 116 of one vane is nearly parallel to the adjacent second surface 118 of the next vane. With major lengths of these surfaces being straight, a major portion of the space 119 therebetween will have nearly constant width. FIG. 2 further shows a line (or longitudinal plane) 502 extending substantially medially through one of the spaces 119. A radial line (longitudinal radial plane) 504 intersects the line/plane 502 at a center 506 of the space 119 and is at an angle $\theta_2$ thereto. Non-zero $\theta_2$ is effective to impart swirl. Exemplary $\theta_2$ may be between 5° and 45°, more narrowly, 15° and 30°.

Figure 5:
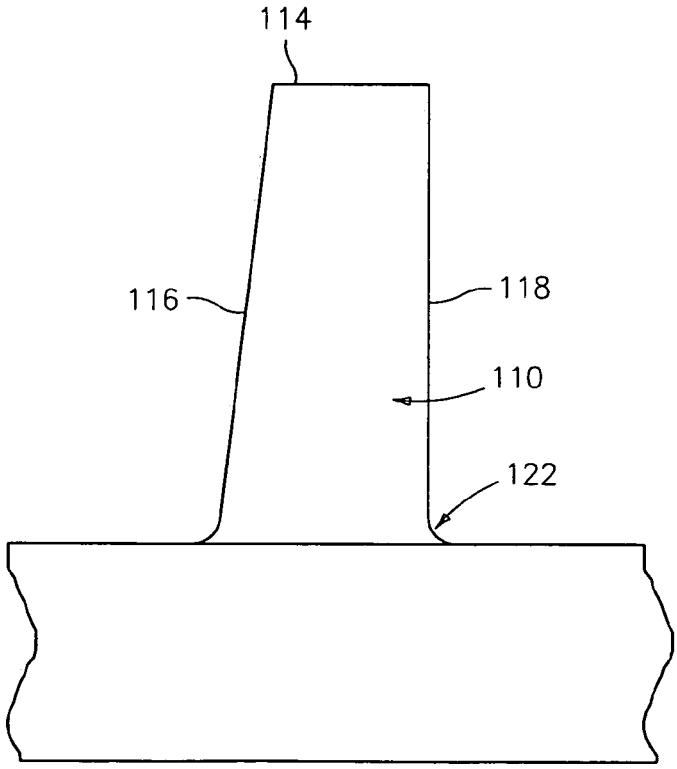
FIG. 5 is a leading edge view of a vane of FIG. 3, taken along line 5-5.
Figure 4:
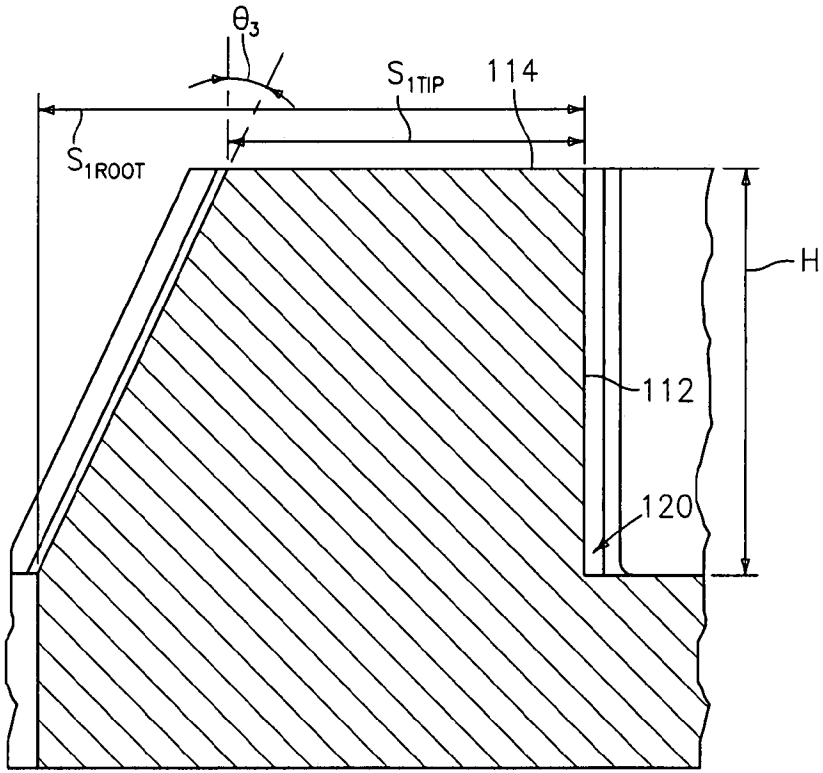
FIG. 4 is a medial sectional view of a vane of FIG. 3, taken along line 4-4.
Figure 3:
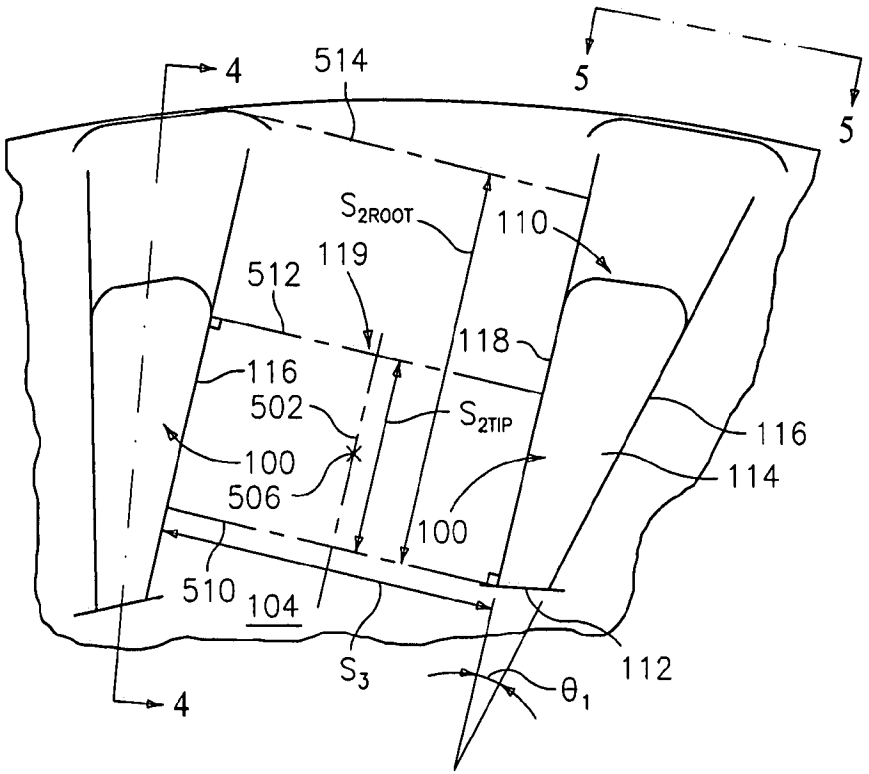
FIG. 3 is an enlarged view of two vanes of the array of FIG. 2.

FIG. 4 shows the vane as tapering in chord length from its proximal end 120 toward its distal end 114. In the exemplary embodiment, the chord length near the proximal end is shown as $S_{1ROOT}$ and the chord length at the distal end is shown as $S_{1TIP}$ with a height from the proximal end to the distal end shown as H. FIG. 5 further shows an exemplary blending or filleting 122 along the vane sides. If such filleting is present along the leading and trailing edge portions, it may affect actual chord length. FIG. 4 further shows the exemplary trailing edge 112 as extending longitudinally. The leading edge 110 is inclined to provide the taper. In the exemplary embodiment, the leading edge (or a major portion thereof) is inclined at an angle $\theta_3$ off vertical as measured in the section of FIG. 4. In the exemplary embodiments, $S_{1TIP}$ is $\leqq$75% of $S_{1ROOT}$ and $\geqq$25%. Exemplary $\theta_3$ may be between 10° and 40°, more narrowly, 15° and 30°. FIG. 3 shows a line (longitudinal plane) 510 extending through the space 119 from the intersection of the flat trailing edge 112 and the adjacent vane second side surface 118 of one adjacent vane and intersecting along the first side 116 of the other adjacent vane. FIG. 3 further shows a line 512 extending normal to that first side surface 116 from the beginning of the flat portion thereof and intersecting the second side 118 of the first vane (at the distal end 114 thereof). FIG. 3 further shows a similar line 514 at the proximal end. A separation (length) between the line/plane 510 and the second line 512, 514 will progressively vary along the span of the vanes. The separation is shown as $S_2$ with specific lengths $S_{2TIP}$ and $S_{2ROOT}$ shown. FIG. 3 further shows $S_3$ as the width of the space 119 at the line/plane 510.

The effect of the tapering vanes is to reduce the imparted swirl along the reduced chordline length. Such tapering may be used to achieve the same or similar flow properties as are identified in the '937 patent. It is noted that the exemplary embodiment of the '937 patent places the proximal ends of its vanes on the prefilmer whereas the present exemplary embodiment places the proximal ends on or near the bearing for ease of manufacturability. Accordingly, this factor should be remembered to avoid confusion. Thus, whereas the aft (proximal) ends of the '937 patent vanes are at lower angle than the fore (distal) ends the presently-illustrated embodiment has an aft (distal) chord length smaller than a fore (proximal) chord length to achieve a similar fore-to-aft swirl reduction. This, in turn, produces in a downstream portion of the first duct a tailored profile that has both a relatively low swirl value (e.g., less than 25°) near the prefilmer and a peak swirl value at a relatively high radial location inboard thereof (e.g., at least 20% of an exit radius). In the exemplary resulting stretched Rankine vortex, the peak swirl angle (90°) marks the transition between the inboard recirculation zone solid body rotation and the outboard free vortex. An exemplary range for the radius of this transition is 0-25% of the exit radius (e.g., of the surface 60 at the outlet 66). As the higher numbers may be more advantageous, narrower ranges of 15-25% or 20-25% may be appropriate. The swirl angle at the prefilmer may best be characterized as just outside of any boundary layer. Typically, this will fall at a radius of at least 95% of the exit radius. This swirl angle may typically be at least 15° (e.g., 15-25° or, more narrowly, 18-21°).

The local degree of turning of the flow may be less than $\theta_2$ if, locally, the space 119 does not have sufficient length. For the exemplary vane configuration, the turning has been observed to be substantially $\theta_2$ where the ratio of the length $S_2$ to the separation $S_3$ is greater than approximately 0.5. Where less than this value, the turning will be incomplete and only a portion of $\theta_2$. In exemplary implementations, essentially full turning is desired near the front (proximal) ends of the vanes and, less than full turning is desired near the aft (distal) ends. An exemplary $S_{2ROOT}$ may be greater than 0.5 and an exemplary $S_{2TIP}$ may be $\leqq 0.25$. An exemplary amount of turning provided at the tip is 35%-60% of $\theta_2$. For other vane configurations, appropriate relationships may be determined by modeling or measurement.

One or more embodiments of the present invention have been described. Nevertheless, it will be understood that various modifications may be made without departing from the spirit and scope of the invention. For example, when the invention is applied to the reengineering of an existing swirler, details of the existing swirler and/or associated manufacturing techniques may influence details of any associated implementation. Additionally, the invention may be combined with other modifications either presently known or to be developed. Accordingly, other embodiments are within the scope of the following claims.

What is claimed is:

1. A swirler vane pack comprising:

an annular passageway having passageway extending radially inward from an inlet and curving aft to an axial outlet;

an array of vanes in the passageway at the inlet; and means holding the vanes, wherein each of the vanes has:

first and second ends with a span therebetween; and a spanwise changing section comprising a spanwise changing chord.

2. The vane pack of claim 1 wherein:

a spacing between adjacent ones of said vanes is essentially spanwise constant.

3. The vane pack of claim 1 wherein:

the second end has a chord that is 25-75% of a chord of the first end.

4. The vane pack of claim 1 wherein:

the spanwise changing section comprises a spanwise monotonically changing chord.

5. The vane pack of claim 1 wherein:

the vanes are unitarily formed with the means;

the vane first ends are proximal of the means and the vane second ends are distal of the means; and the spanwise changing section comprises a chord spanwise monotonically distally decreasing.

6. The vane pack of claim 1 wherein:

the spanwise changing section is essentially symmetric across a chord.

7. The vane pack of claim 1 wherein:

the spanwise changing section is characterized by first and second flat facets along a major portion of a chordwise length of the vanes.

8. The vane pack of claim 1 wherein:

each of the vanes is untwisted.

9. A method for engineering a swirler vane pack, the swirler vane pack comprising:

an annular passageway having passageway extending radially inward from an inlet and curving aft to an axial outlet; and an array of vanes in the passageway at the inlet; each of the vanes having first and second ends with a span therebetween;

the method comprising:

determining a target change in swirl angle across the annular passageway; and determining a distribution of spanwise change in section effective to achieve the target change in swirl angle at a target operating condition.

10. The method of claim 9 further comprising:

measuring lean blow out characteristics of a swirler incorporating the vane pack.

11. A swirler assembly comprising:

a fuel injector;

a bearing coaxial with the fuel injector and having an outer surface forming a first surface of a first passageway from an inlet to an axial outlet;

a prefilmer coaxial with the fuel injector and having an inner surface forming a second surface of the first passageway and an outer surface forming first surface of a second passageway from an inlet to an axial outlet;

a first array of vanes in the first passageway, each vane extending from a first end proximate the first passageway first surface to a second end proximate the first passageway second surface and having a section characterized by a spanwise decrease in chord of at least 25% from said first end to said second end; and a second array of vanes in the second passageway.

12. The swirler assembly of claim 11 wherein the spanwise decrease in chord is effective to provide, at a target operating condition, a discharge profile characterized by swirl angle of:

a peak value located between 0% and 25% of an exit radius; and a swirl angle of between 15° and 25° at a location between 95% and 100% of the exit radius.

13. The swirler assembly of claim 11 wherein the spanwise decrease in chord is effective to provide, at a target operating condition, a discharge profile characterized by swirl angle of:

a peak value located between 15% and 25% of an exit radius; and a swirl angle of between 18° and 21° at a location between 95% and 100% of the exit radius.

14. The swirler assembly of claim 13 wherein the peak value is in excess of 85°.

15. The swirler assembly of claim 11 wherein the first passageway inlet and the second passageway inlet are circumferential inlets.

16. A high shear designed fuel injector for a combustor of a gas turbine engine comprising a fuel nozzle supported at an inlet of said combustor, a first radial inlet swirler mounted on said fuel nozzle and including a first passage for flowing air into the combustor and being coaxially disposed relative to said fuel nozzle, a second radial inlet swirler mounted adjacent to said first radial swirler and including a second passage for flowing additional air into the combustor and being concentrically disposed relative to said first passage, said first radial inlet swirler having circumferentially disposed vanes, each of said vanes having a span between first and second ends and having a spanwise change in section effective to change the swirl angle from the first end to the second end to offset the swirl to a higher level that the swirl would be without the change in section to produce a Rankine vortex.

17. The high shear designed fuel injector of claim 16 wherein:

a majority of the air in the first passage and second passage is in the first passage.

18. The high shear designed fuel injector of claim 16 wherein:

the amount of air in the first passage is substantially equal to 50%-95% of the total air flow in the first passage and second passage.

19. The high shear designed fuel injector of claim 16 wherein:

a bulk swirl angle of air at a discharge of said second passage is substantially between 60°-75°.

* * * * *